US007711555B2

(12) United States Patent
Suzuki

(10) Patent No.: US 7,711,555 B2
(45) Date of Patent: May 4, 2010

(54) METHOD FOR COMPRESSION AND EXPANSION OF DIGITAL AUDIO DATA

(75) Inventor: Toshihiko Suzuki, Hamamatsu (JP)

(73) Assignee: Yamaha Corporation (JP)

( * ) Notice: Subject to any disclaimer, the term of this patent is extended or adjusted under 35 U.S.C. 154(b) by 1010 days.

(21) Appl. No.: 11/420,780

(22) Filed: May 29, 2006

(65) Prior Publication Data

US 2006/0271374 A1 Nov. 30, 2006

(30) Foreign Application Priority Data

May 31, 2005 (JP) ..... 2005-159484

(51) Int. Cl.
*G10L 19/14* (2006.01)
*G10L 19/00* (2006.01)
*G10L 21/04* (2006.01)

(52) U.S. Cl. ..... 704/211; 704/200.1; 704/503

(58) Field of Classification Search ..... None
See application file for complete search history.

(56) References Cited

U.S. PATENT DOCUMENTS

| | | | | |
|---|---|---|---|---|
| 5,040,217 | A * | 8/1991 | Brandenburg et al. | 704/200.1 |
| 5,394,473 | A * | 2/1995 | Davidson | 704/200.1 |
| 5,408,580 | A * | 4/1995 | Stautner et al. | 704/205 |
| 5,440,596 | A | 8/1995 | Kneepkens et al. | |
| 6,180,861 | B1 | 1/2001 | Hashimoto | |
| 6,226,608 | B1 * | 5/2001 | Fielder et al. | 704/229 |
| 6,424,936 | B1 * | 7/2002 | Shen et al. | 704/200.1 |
| 7,222,068 | B2 * | 5/2007 | Leaning et al. | 704/201 |
| 2004/0088161 | A1 * | 5/2004 | Corrigan et al. | 704/211 |
| 2005/0143979 | A1 * | 6/2005 | Lee et al. | 704/208 |
| 2005/0240397 | A1 * | 10/2005 | Jeon | 704/219 |

FOREIGN PATENT DOCUMENTS

| | | | |
|---|---|---|---|
| CN | 10-0303580 | B1 | 7/2001 |
| CN | 1461112 | A | 12/2003 |
| JP | 6167978 | A | 6/1994 |
| JP | 2734323 | B2 | 1/1998 |
| JP | 2002-341896 | A | 11/2002 |
| JP | 3572090 | B2 | 7/2004 |

(Continued)

OTHER PUBLICATIONS

Office Action issued in corresponding Korean patent app. No. 10-2006-0048065, mailed Sep. 28, 2007.

(Continued)

*Primary Examiner*—David R Hudspeth
*Assistant Examiner*—Brian L Albertalli
(74) *Attorney, Agent, or Firm*—Rossi, Kimms & McDowell LLP

(57) ABSTRACT

Digital audio data are divided into a plurality of frames, each of which includes a desired number of sub-band samples, which are gradually increased in a range between "16" and "1024", and are then compressed by way of psychoacoustics analysis and quantization, whereby compressed data are realized with a high compression ratio and small tone-generation latency. The compressed data are decoded by way of inverse quantization and sub-band synthesis, so that decoded data are sequentially written into a memory (e.g., a FIFO memory). Decoding is appropriately turned on or off in response to a presently vacant capacity of the memory.

5 Claims, 3 Drawing Sheets

FOREIGN PATENT DOCUMENTS

WO 99/29133 A1 6/1999

OTHER PUBLICATIONS

Office Action issued in corresponding Korean patent application No. 10-2006-0048065, mailed Sep. 28, 2007.

Notification of First Office Action issued in corresponding Chinese application No. 200610089934.2, dated Jun. 13, 2008.

English translation of Chinese application No. CN1461112A, previously submitted in an Information Disclosure Statement filed on Sep. 12, 2008.

* cited by examiner

METHOD FOR COMPRESSION AND EXPANSION OF DIGITAL AUDIO DATA

BACKGROUND OF THE INVENTION

1. Field of the Invention

This invention relates to methods for compression and expansion of digital audio data having small latency.

This application claims priority on Japanese Patent Application No. 2005-159484, the content of which is incorporated herein by reference.

2. Description of the Related Art

It is well known that methods for compressing digital audio data are realized by way of ADPCM (i.e., Adaptive Differential Pulse-Code Modulation) and LPC (i.e., Linear Predictive Coding) as well as sub-band coding such as MP3 (i.e., MPEG Audio Layer 3) and MPEG Audio AAC (Advanced Audio Coding).

Linear predictive coding methods perform compression on digital audio data in units of samples so that they can start playback (or tone-generation processing) without delays due to expansion (or decoding); hence, they realize small tone-generation latency but not realize a high compression ratio in comparison with sub-band coding methods. Sub-band coding methods perform compression on plural samples in units of frames (or blocks); hence, they realize a high compression ratio in comparison with linear predictive coding methods. However, sub-band coding methods cannot start playback before completion of expansion of all samples included in a top frame; hence, an expansion time becomes longer as the number of samples included in each frame becomes large, which in turn increases tone-generation latency. Documents entitled Japanese Patent No. 2734323 and International Publication No. WO99/29133 teach data compression methods realizing improvements of tone-generation latencies while securing high compression performance.

SUMMARY OF THE INVENTION

It is an object of the present invention to provide a method for compression and expansion of digital audio data having small tone-generation latency.

In a first aspect of the present invention, data compression is performed in such a way that a series of sampling data are divided into n frames, wherein the number of samples included in each frame is gradually increased from a first frame to a k-th frame, where $1<k<n$ (where k and n are integers); thereafter, the sampling data included in each frame are divided into a plurality of sub-band signals, which are then subjected to quantization by way of psychoacoustics analysis, thus producing compressed data.

Specifically, digital audio data are divided into a plurality of frames, each of which includes a desired number of sub-band samples, which is gradually increased in a range between "16" and "1024" with respect to an attack portion of a musical tune; and each of the frames is compressed by way of psychoacoustics analysis and quantization, thus producing compressed data with a small tone-generation latency.

In a second aspect of the present invention, data expansion is performed using n frames, each of which include a plurality of sub-band-signals corresponding to compressed data, wherein the number of samples included in each frame is gradually increased from a first frame to a k-th frame, where $1<k<n$ (where k and n are integers); thereafter, the compressed data are subjected to decoding in units of frames so as to reproduce a series of sampling data before compression, and the sampling data are sequentially written into a memory, wherein decoding is controlled in response to a vacant capacity of the memory.

Specifically, compressed data are decoded in units of frames by way of inverse quantization and sub-band synthesis. Decoded data are sequentially written into a memory (e.g., a FIFO memory), wherein decoding is appropriately turned on or off in response to a presently vacant capacity of the memory.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

The present invention will be described in further detail by way of examples with reference to the accompanying drawings.

Figure 1:
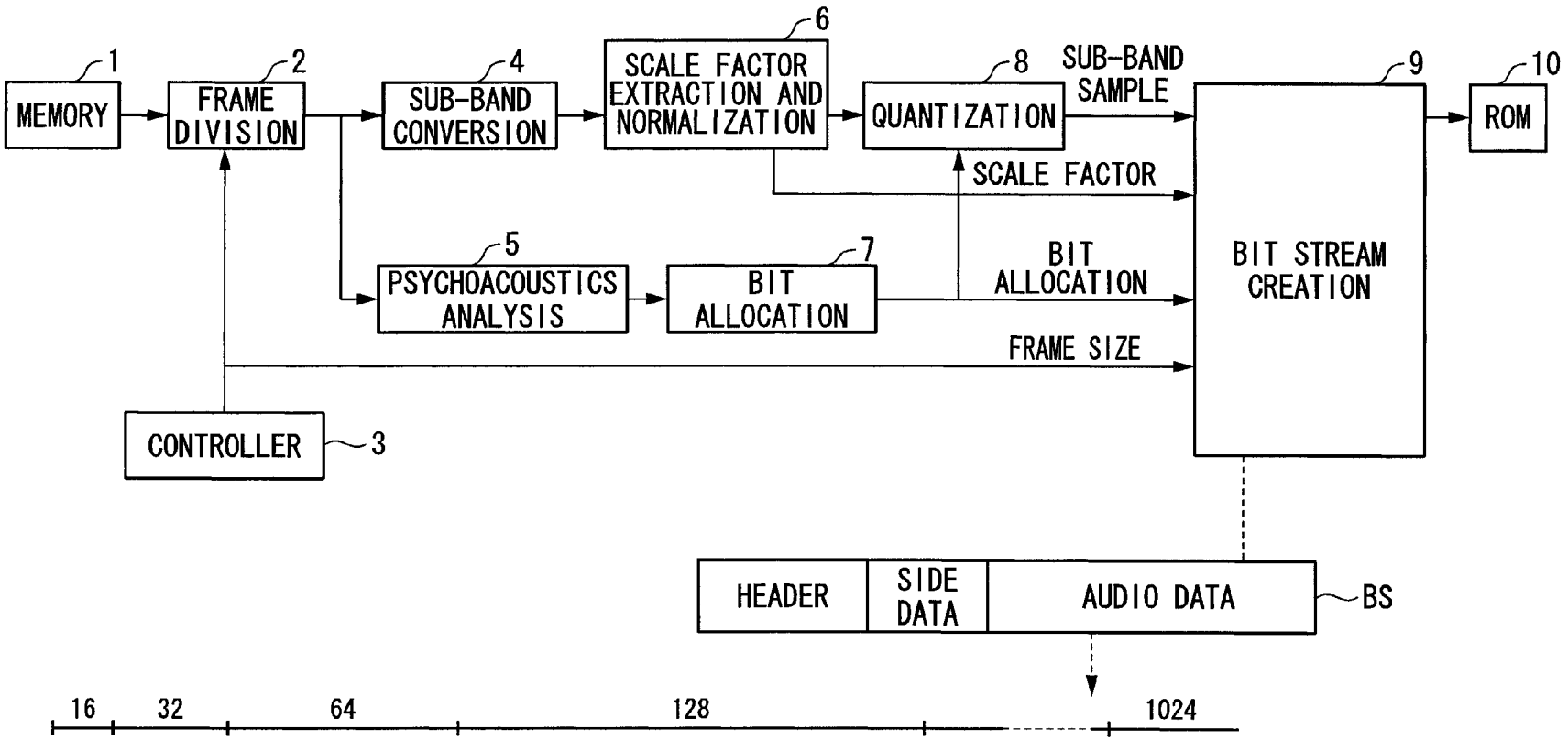
FIG. 1 is a block diagram showing a data compression circuit in accordance with a preferred embodiment of the present invention.

FIG. 1 is a block diagram showing the constitution of a data compression circuit in accordance with a preferred embodiment of the present invention. The data compression circuit of FIG. 1 employs a sub-band coding method for compressing digital audio data. To cope with playback of a musical tune using digital audio data, the data compression circuit is designed to vary the number of samples included in one frame with respect to an attack portion (or a top portion) of a musical tune (see a bar graph shown in the bottom of FIG. 1). That is, in contrast to the conventional sub-band coding method in which the number of samples included in one frame is set to a fixed 1024, the present embodiment is characterized in that the number of samples included in one frame can be varied as 16, 32, 64, 128, 256, . . . , and 1024, wherein it is gradually increased by a factor "2" and finally reaches "1024", which is fixed so that compression is performed with respect to 1024 samples per frame.

The details of the data compression circuit of FIG. 1 will be described.

Reference numeral 1 designates a memory for storing digital audio data (e.g., PCM data) before compression, i.e., a series of sampling data. Reference numeral 2 designates a frame division block that sequentially reads digital audio data including plural samples, the number of which is designated by a frame size given from a controller 3, from the memory 1 in units of frames. Then, the read digital audio data are delivered to a sub-band conversion block 4 and a psychoacoustics analysis block 5. At first, 16 samples are read from the memory 1 and are then delivered to the sub-band conversion block 4 and the psychoacoustics analysis block 5. Next, 32 samples are read from the memory 1 and are then delivered to the sub-band conversion block 4 and the psychoacoustics analysis block 5. Next, 64 samples are read from the memory 1 and are then delivered to the sub-band conversion block 4 and the psychoacoustics analysis block 5. Next, 128 samples are read from the memory 1 and are then delivered to the sub-band conversion block 4 and the psychoacoustics analysis block 5. Similarly, 256 samples and 512 samples are read from the memory 1 and are then delivered. Finally, 1024 samples are read from the memory 1 and are then delivered to the sub-band conversion block 4 and the psychoacoustics analysis block 5.

The sub-band conversion block 4 divides input data thereof into plural sub-band signals each having the same band width with respect to a prescribed number of sub-bands. When the prescribed number is set to 16, input data are divided into 16 sub-band signals, each of which is thus subjected to down-sampling at 1/16 of the sampling frequency. When the prescribed number is set to 32, input data are divided into 32 sub-band signals, each of which is thus subjected to down-sampling at 1/32 of the sampling frequency. A scale factor extraction and normalization block 6 detects a sample having a maximum value within sub-band samples included in one frame, wherein the maximum value is quantized to produce a scale factor. Then, each of sub-band signals is divided using the scale factor and is then normalized within a prescribed range of ±1.

The psychoacoustics analysis block 5 performs calculations using fast Fourier transform (FFT) with respect to frequency spectrum, based on which masking thresholds (i.e., allowable quantization noise power) are produced with respect to sub-bands. A bit allocation block 7 performs repetition loop processing based on the output of the psychoacoustics analysis block 5 and under the limitation regarding the number of bits, which is usable per frame and which is determined by a bit rate, thus determining the number of quantization bits per each sub-band. The bit allocation block 7 can reduce the number of bits allocated to each frame while securing a high playback quality substantially equivalent to an original playback quality realized by compressed digital audio data; therefore, it is possible to increase a compression ratio as the basic frame size for compressed digital audio data is set to a large number (e.g., 1024 samples). A quantization block 8 performs quantization on sub-band signals, which are output from the scale factor extraction and normalization block 6, in light of the number of quantization bits, which is set with respect to each sub-band. A bit stream creation block 9 produces a bit stream BS per each frame on the basis of the outputs of the scale factor extraction and normalization block 6, bit allocation block 7, and quantization block 8. The bit stream BS includes audio data (corresponding to quantized sub-band samples) and side data (including bit allocation information per each sub-band, the scale factor, and the frame size output from the controller 3). A header is added to the aforementioned data so as to complete the bit stream BS, which is then written into a ROM 10.

Next, the details of a data expansion circuit for performing expansion on the bit stream 10 read from the ROM 10 will be described.

Figure 2:
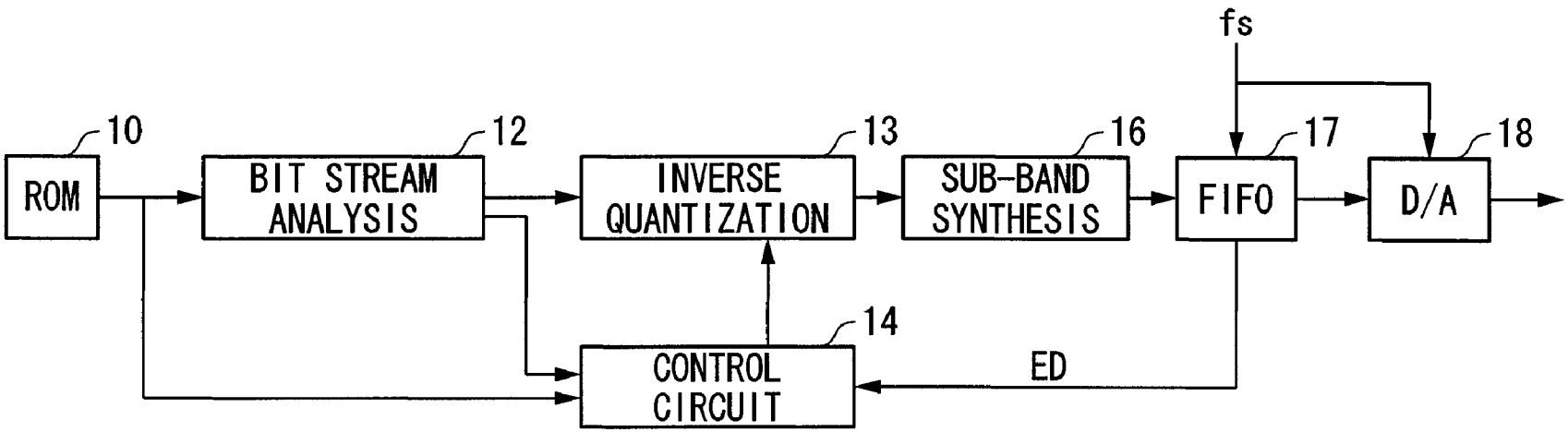
FIG. 2 is a block diagram showing a data expansion circuit in accordance with the preferred embodiment of the present invention.

FIG. 2 is a block diagram showing the constitution of the data expansion circuit, wherein the aforementioned bit stream BS is read from the ROM 10. A header of the bit stream BS read from the ROM 10 is supplied to a control circuit 14, while sub-band samples and side data included in the bit stream 10 are supplied to a bit stream analysis block 12. Specifically, the bit stream analysis block 12 isolates the quantized sub-band samples and the side data from the bit stream BS read from the ROM 10, so that the sub-band samples are supplied to an inverse quantization circuit 13, while the side data are supplied to the control circuit 14. The inverse quantization circuit 13 performs inverse quantization on the sub-band samples and also performs multiplication using scale factors, thus producing sub-band data. The sub-band data are collectively supplied to a sub-band synthesis circuit 16 in correspondence with the prescribed number of sub-bands, which is determined in advance.

The control circuit 14 controls several blocks of the data expansion circuit of FIG. 2, wherein it produces read addresses for the ROM 10 upon reception of an instruction from a CPU (i.e., a central processing unit, not shown). In addition, it receives the side data output from the bit stream analysis block 12 so as to output the bit allocation information and scale factors to the inverse quantization circuit 13. Furthermore, it controls decoding performed by the inverse quantization circuit 13 and the sub-band synthesis circuit 16 on the basis of data ED output from a first-in-first-out (FIFO) memory 17. Details of decoding will be described later.

The sub-band synthesis circuit 16 synthesizes sub-band data, which are output from the inverse quantization circuit 13 in correspondence with the prescribed number of sub-bands, so as to reproduce original digital audio data before compression by way of decoding. Samples of decoded digital audio data are supplied to the FIFO memory 17. Samples of decoded digital audio data stored in the FIFO memory 17 are sequentially supplied to a digital-to-analog (D/A) converter 18 in synchronization with the timings of sampling pulses (whose frequency is represented as fs). In addition, the FIFO memory 17 normally indicates the present vacant capacity thereof represented by the data ED, which is supplied to the control circuit 14. The D/A converter 18 converts the digital audio data output from the FIFO memory 17 into analog musical tone signals.

Figure 3:
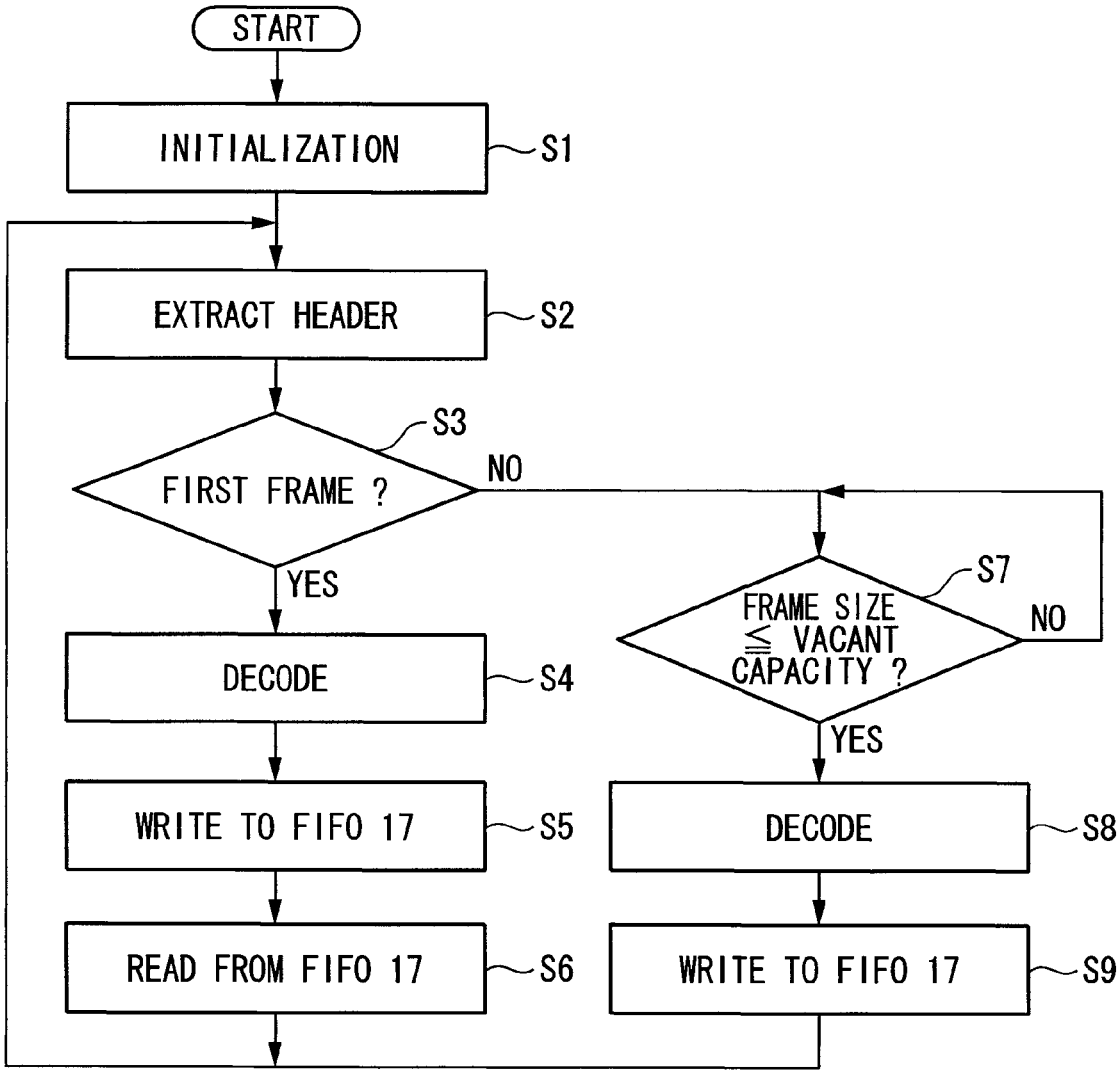
FIG. 3 is a flowchart showing the overall operation of the data expansion circuit shown in FIG. 2.

Next, the overall operation of the data expansion circuit of FIG. 2 will be described with reference to FIG. 3.

Upon reception of a start instruction from the CPU (not shown), the control circuit 14 performs initialization on various blocks of the data expansion circuit of FIG. 2, and it also clears the stored content of the FIFO memory 17 (see step S1). Next, it outputs addresses for reading out a first frame to the ROM 10. Thus, a bit stream BS corresponding to the first frame is read from the ROM 10, so that a header thereof is supplied to the control circuit 14 (see step S2), while sub-band samples and side data thereof are supplied to the bit stream analysis block 12. The bit stream analysis block 12 isolates the side data and the quantized sub-band samples from the bit stream BS, so that the sub-band samples are supplied to the inverse quantization circuit 13, while the side data are supplied to the control circuit 14.

The control circuit 14 makes a decision as to whether or not the present frame matches the first frame on the basis of the header of the bit stream data BS (see step S3). In the case of the first frame, the control circuit 14 supplies the bit allocation information and scale factor included in the side data to the inverse quantization circuit 13 to start inverse quantization. Thus, the inverse quantization circuit 13 performs inverse quantization on sub-band samples and also performs multiplication using the scale factor so as to produce sub-band data, which are then supplied to the sub-band synthesis circuit 16. The sub-band synthesis circuit 16 synthesizes 32 sub-band data output from the inverse quantization circuit 13 so as to reproduce original digital audio data before compression, which are then supplied to the FIFO memory 17. Thus, decoding is performed as described above (see step S4), so that the decoded digital audio data are stored in the FIFO memory 17 (see step S5). After completion of writing operation, data are read from the FIFO memory 17.

Since the first frame includes 16 samples (designated by the aforementioned frame size), decoding (see step S4) can be performed in a short period of time; hence, sound is produced with a substantially zero delay.

Next, the control circuit output addresses for reading out a second frame to the ROM 10. Thus, a bit stream corresponding to the second frame is read from the ROM 10, whereby a header thereof is supplied to the control circuit 14 (see step S2), while sub-band samples and side data thereof are supplied to the bit stream analysis block 12. The control circuit 14 receives data ED representing the present vacant capacity of the FIFO memory 17 so as to compare the size of the second frame with the present vacant capacity of the FIFO memory 17 (see step S7). Incidentally, the frame size of each frame is included in side data, which is set into the control circuit 14.

When the present vacant size is smaller than the frame size, the FIFO memory 17 is placed in a stand-by state until the present vacant size becomes larger than the frame size (see step S7). When the present vacant size becomes larger than the frame size, the control circuit 14 outputs the bit allocation information and scale factor to the inverse quantization circuit 13 so as to start inverse quantization. Thereafter, the aforementioned operations are similarly performed so as to perform decoding (see step S8), so that the decoding results are stored in the FIFO memory 17 (see step S9).

Similarly, subsequent bit streams (e.g., third, fourth, and fifth frames) are sequentially read from the ROM 10 and are subjected to decoding (see steps S7 to S9), so that decoding results are sequentially stored in the FIFO memory 17. Samples of decoded digital audio data stored in the FIFO memory 17 are sequentially read from the FIFO memory 17 in a first-in-first-out manner in synchronization with the timings of sampling pulses (fs) and are then converted into analog musical tone signals by way of the D/A converter 18. Normally, the FIFO memory 17 has a prescribed capacity corresponding to 1024×2 samples. That is, a sufficiently large vacant capacity exists in the FIFO memory 17 just after completion of tone-generation processing; hence, subsequent samples are stored in the FIFO memory 17 without causing a substantial wait time in step S7. In summary, the present invention is designed to produce a decoding room allowing each frame having numerous samples to be decoded without causing sound intermission since samples of digital audio data subjected to sequential reading are gradually accumulated in the FIFO memory 17 after the playback start timing.

As described above, the present embodiment is characterized in that the number of samples included in each of frames corresponding to a top portion of digital audio data (i.e., a playback start portion of a musical tune) is set to a prescribed number such as 16, 32, 64, . . . , each of which is smaller than the original number of samples, i.e., 1024. It is well known that decoding performed by the inverse quantization circuit 13 and the sub-band synthesis circuit 16 can be completed in a short period of time as the number of samples subjected to decoding is small. For this reason, the present embodiment can reduce the latency (or a tone-generation delay) at the playback start timing of digital audio data (i.e., the playback start timing of a musical tune). The number of samples included in each of frames corresponding to a top portion of digital audio data (or an attack portion of a musical tune) is gradually increased from 16 to 1024, then, it is set to an original number after progression of the top portion of digital audio data; hence, it is possible to further increase a compression ratio. As the basic frame size for compressed digital audio data is set to a relatively large number, it is possible to improve a compression ratio while securing a high playback quality equivalent to an original playback quality of digital audio data.

The numbers of samples set to the playback start timing are not necessarily limited to the aforementioned sequence. For example, the number of samples per each frame can be varied in a desired sequence like 16, 16, 32, 32, 64, 64, . . . , for example. In short, the sequence can be freely determined to avoid sound break in playback as long as the writing operation progresses faster than the reading operation with respect to the FIFO memory 17, wherein it depends upon the decoding speed. Specifically, the number of samples included in each of frames corresponding to the top portion of digital audio data is gradually increased and finally reaches 1024. In playback of digital audio data, when the total decoding time for each frame including 1024 samples matches a prescribed value produced by multiplying 512 (samples) and the time interval between sampling pulses (fs), it is necessary for the FIFO memory 17 to store at least 512 samples in advance at the timing of starting a decoding process on a top frame including 1024 samples. Hence, the sequence must be determined to satisfy such a need. In addition, it is preferable that the sequence be determined using the 2's square in order to simplify the constitution of the data compression circuit.

The present invention is not necessarily limited to compression and expansion of musical tone data and can be applied to compression and expansion of other types of digital data. The present invention is applicable to sound sources and tone generators incorporated in game devices and audio devices, for example.

Lastly, the present invention is not necessarily limited to the aforementioned embodiment, which is illustrative and not restrictive; hence, any modifications and design changes can be embraced within the scope of the invention defined by the appended claims.

What is claimed is:

1. A data compression method in a data compression device comprising the steps of:

dividing a series of sampling data with a first divider into n frames in such a way that a number of samples including in subsequent frames is gradually increased from a first frame to a k-th frame, where $1<k<n$ in which k and n are integers;

dividing the sampling data with a second divider included in each frame into a plurality of sub-band signals; and performing a quantization with a compressor on the sub-band signals by way of psychoacoustics analysis, thus producing compressed data.

2. The data compression method according to claim 1, wherein the series of sampling data correspond to digital audio data.

3. A data compression device comprising:

a first divider for dividing a series of sampling data into n frames in such a way that a number of samples included in subsequent frames is gradually increased from a top frame to a k-th frame, where $1<k<n$ in which k and n are integers;

a second divider for dividing the sampling data included in each frame into a plurality of sub-band signals; and a compressor for performing quantization on the sub-band signals by way of psychoacoustics analysis, thus producing compressed data.

4. A data expansion device comprising:

a first memory for storing compressed data including n frames, each of which include a plurality of sub-band signals, wherein a number of samples included in subsequent frames is gradually increased from a first frame to a k-th frame, where $1<k<n$ in which k and n are integers;

a decoder for decoding the compressed data in units of frames so as to reproduce a series of sampling data before compression;

a first-in-first-out memory into which a plurality of reproduced sampling data are written and from which the plurality of written sampling data are read out sample by sample in accordance with a timing conforming to a sampling frequency; and a controller for controlling a decoding process of the decoder in response to a vacant capacity of the first-in-first out memory, wherein the decoder decodes the compressed data in units of frames in such a way that a number of sampling data accumulated in the first-in-first-out memory gradually increases.

5. The data expansion device according to claim 4, wherein the series of sampling data correspond to digital audio data.

* * * * *